US005086583A

United States Patent [19]

Breen

[11] Patent Number: 5,086,583

[45] Date of Patent: Feb. 11, 1992

[54] METHOD AND APPARATUS FOR HOLDING CUT TREES

[76] Inventor: William C. Breen, 126 S. Portage Path Apt. 5, Akron, Ohio 44303

[21] Appl. No.: 555,090

[22] Filed: Jul. 18, 1990

[51] Int. Cl.[5] ..... A47G 7/02

[52] U.S. Cl. ..... 47/40.5; 206/524

[58] Field of Search ..... 206/524; 47/40.5, 41.13

[56] References Cited

U.S. PATENT DOCUMENTS

| | | | |
|---|---|---|---|
| 417,815 | 12/1889 | Diek | 47/40.5 |
| 2,928,633 | 3/1960 | Holmes | 47/40.5 |
| 2,980,377 | 4/1961 | Nielsen | 47/40.5 |
| 4,941,572 | 7/1990 | Harris | 206/524 |

*Primary Examiner*—Henry E. Raduazo

*Attorney, Agent, or Firm*—Renner, Kenner, Greive, Bobak, Taylor & Weber

[57] ABSTRACT

A method and apparatus for securing a cut tree is presented. A tree stand has a frustro conical side wall connected to a base at a bottom thereof, and having an aperture at the top. The aperture communicates with the receptacle adapted for receiving a tree trunk. An opening in the frustro conical side wall allows the introduction of water into a cavity defined by such side wall. A further opening in the receptacle communicates with the cavity, allowing water to enter therein and surround a tree trunk received thereby. Securement of the tree trunk within the receptacle is achieved by the introduction of a closed cell foam introduced about the tree trunk within the receptacle, forming a frustro conical ring thereabout.

8 Claims, 1 Drawing Sheet

METHOD AND APPARATUS FOR HOLDING CUT TREES

TECHNICAL FIELD

The invention herein resides in the art of holders and securing devices. More particularly, the invention relates to a holder and securing device having a pair of receptacles, one for receiving and securing an item, and the other for communicating a replenishment fluid to the item, while providing mass to the holder itself. Specifically, the invention relates to a holder and securing device and related technique for receiving and maintaining a cut tree such as a Christmas tree therein.

BACKGROUND ART

It is well known to decorate pines or fir trees at Christmas time as a part of the Holiday celebration. Traditionally, such trees are "live" trees, having been cut at the trunk, thereafter being designated as "cut" trees. Presently, it has also been known to use artificial trees, fabricated to replicate a live or cut tree. While live or cut trees are generally preferred aesthetically, artificial trees have become increasingly popular due to safety considerations and ease of assembly.

Cut trees must be secured in a stand or base having sufficient breadth to stabilize the tree extending thereabove. Typically, the stand also requires a cavity for receiving a reservoir of water therein to replenish liquid lost by the tree through evaporation. The water transfers to the tree trunk received within the water reservoir by means of absorption or osmosis. Such reservoir of water is necessary to keep the tree looking alive, allowing it to maintain its needles, while reducing its susceptibility to fire.

Prior stands have typically provided a small recepcable for water maintained by four legs extending therefrom and orthogonal to each other. Positioned above the water receptacle is a ring having three or more threaded spikes passing therethrough for engaging the tree trunk, thereby securing it in a specific position or orientation. Such prior tree stands have been difficult to use. They require the user to access the tree from various directions at the base thereof in order to threadedly engage the spikes with the trunk. The implementation of such a stand generally requires two individuals, a first holding the tree in a desired alignment, while the second moves about under the tree securing the trunk with the spikes. Such spikes often split the trunk, or in any event introduce large holes into the trunk making resetting or realigning of the tree within the stand a most difficult proposition. Further, the threaded spikes often strip within the collar and are subject to loss or misplacement. The bases of such prior art stands are typically of a small mass, a result of a small water supply therein, thus affording little stability to the tree assembly having a great mass extending thereabove.

DISCLOSURE OF INVENTION

In light of the foregoing, it is a first aspect of the invention to provide a method and apparatus for securing cut trees in which no threaded spikes or other means for piercing the trunk of the tree are required.

Another aspect of the invention is to provide a method and apparatus for securing cut trees which allows rapid placement of the securing element.

Still a further aspect of the invention is to provide a method and apparatus for securing cut trees in which a large volume of water is provided at the base of the tree to provide support and replenish of moisture lost by the tree through evaporation.

Still a further aspect of the invention is the provision of a method and apparatus for securing cut trees in which a single individual may place and secure the tree within the holder or stand.

Yet an additional aspect of the invention is the provision of a method and apparatus for securing a cut tree which is easy to implement with state of the art techniques and structure.

The foregoing and other aspects of the invention which will become apparent as the detailed description proceeds are achieved by a stand for receiving and securing a cut tree, comprising: a base plate; a first side wall extending upwardly from said base plate to an aperture at a top end thereof; a receptacle formed by a second side wall depending from said aperture for receiving a trunk of a cut tree; and securing means interposed between said trunk and said second side wall holding said trunk in a fixed position within said receptacle.

Other aspects of the invention are attained by a method for setting a cut tree in a stand, comprising: placing a trunk of a cut tree into a receptacle surrounded by a cavity; filling a portion of said receptacle with a foam surrounding a portion of said trunk and contacting sides of said receptacle; and allowing said foam to solidify.

DESCRIPTION OF DRAWING

For a complete understanding of the objects, techniques and structure of the invention reference should be made to the following detailed description and accompanying drawing wherein.

BEST MODE FOR CARRYING OUT THE INVENTION

Figure 1:
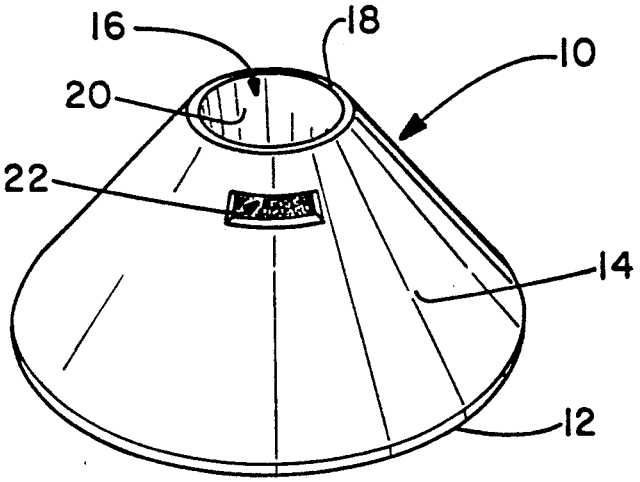
FIG. 1 is a front prospective view of a tree holder or stand according to the invention.
Figure 2:
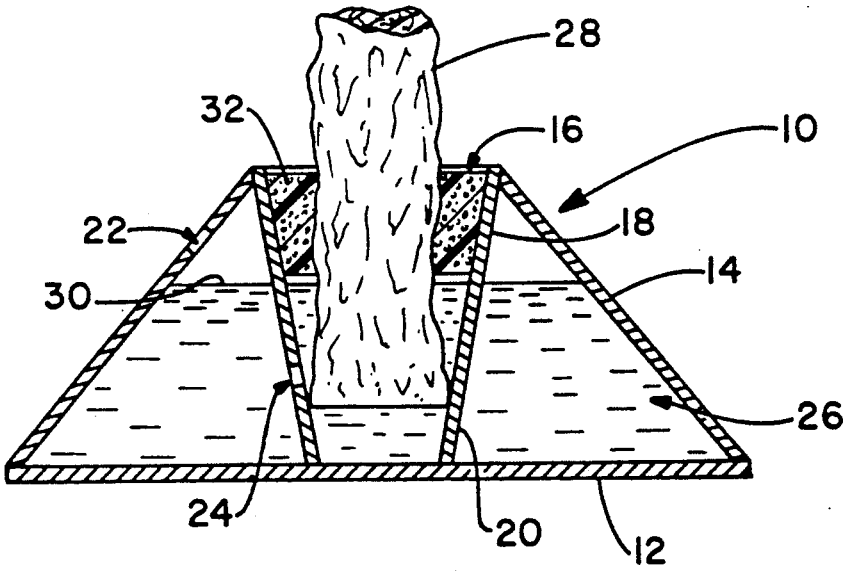
FIG. 2 is a cross sectional view of the tree holder or stand of FIG. 1, showing the same receiving a tree trunk therein.

Referring now to the drawing, it can be seen that a tree base or stand suitable for receiving and maintaining a cut tree is designated generally by the numeral 10. The tree stand 10 includes a base plate 12 of any suitable geometry, but preferably circular and in the form of a disc. A side wall 14 extends upwardly from the base 12 to an aperture 16 at the top thereof. The exact configuration of the side wall 14 will, of course, depend upon the geometries of the base 12 and the aperture 16. In the preferred embodiment, with both being circular in nature, and with the base 12 having a greater diameter than the aperture 16, the side wall 14 is frustro conical.

A receptacle 18 extends downwardly from the aperture 16 to the plate 12. It will, of course, be understood by those skilled in the art that the receptacle 18 could stop short of the base 12, having its own separate base therein, or with no base at all being provided to the receptacle itself. The receptable 18 is formed by a frustro conical wall 20 extending downwardly from its larger end at the aperture 16.

The side wall 14 has an aperture or opening 22 therein communicating with a cavity 26 defined by the side wall 14 and base 12. In like manner, the side wall 20 of the receptacle 18 has an opening or aperture 24 therein, allowing the cavity 26 to communicate with the receptacle 18. The aperture 22 provides a means for water to be poured into the cavity 26, with that water subsequently passing into the receptacle 18 upon reaching the level of the opening 24, such that the level of water within the cavity 26 and the receptacle 18 is the same.

In use, the end of a tree trunk 28 of a cut pine or other tree is placed into the receptacle 18 to either rest upon the base 12 or other base member of the receptacle 18, or to wedge against the side walls 20 thereof. The tree of the trunk 28 is then aligned to an asthetically pleasing posture and a closed cell foam 32 is then sprayed into the receptacle 18 about the trunk 28 to form a frustro conical ring thereabout. The ring of foam 32 engages the trunk about the inner periphery thereof, and engages the side wall 20 of the receptacle 18 about the outer periphery thereof. With the closed cell foam being of the quick setting type, the tree need only be maintained in the desired posture of approximately 5–10 minutes while the ring of closed cell foam 32 solidifies, at which time the tree is maintained within the stand 10 by the ring 32, having a frustro conical side wall which mates with that of the side wall 20 of the receptacle 18.

Water may be introduced into the cavity 26 through the opening 22, such water also entering the receptacle 18 to replenish by absorption and osmosis through the trunk 28 that water lost by the tree through evaporation or the like. It will be appreciated that the water may be introduced into the cavity 26 and receptacle 18 prior to placement of the trunk 28 and foam ring 32, if desired. In a preferred embodiment of the invention, the closed cell foam of the ring 32 is impervious to water, being capable of placement upon the water at the water level 30 without any deteriorating effects upon the curing or setting process. Whether the water is poured into the opening 22 before or after placement of the tree trunk 28 is inconsequential.

In a preferred embodiment of the invention, the close cell foam 32 is nonadherent to the surface of the side wall 20 of the receptacle 18 such that the tree trunk 28 with the ring 32 attached thereto, can be quickly and easily removed from the receptacle 18 when it is desired to discard the tree. If necessary, a release film such a silicone spray, TFE or the like can be adhered to the surface of the side wall 20 for such release purposes. In any event, the tree may be quickly and easily removed from the stand 10 by simply lifting it therefrom. After the tree is discarded, the water from the stand 10 may be emptied with the stand then being stored for future use.

It will also be appreciated that the instant invention provides for resetting of the tree in the event that it has not been aligned properly, or for some reason becomes misaligned. The trunk 28 may simply be removed from receptacle 18, the ring 32 cut therefrom with an knife, with the setting process then being reengaged. Since no spikes or other means have been used to pierce or split the trunk 28, the integrity of trunk remains such that resetting is possible.

It will be readily appreciated by those skilled in the art that various modifications could be made to the concept of the invention without departing from the spirit thereof. As mentioned above, the receptacle 18 might be provided with its own base member for receiving and supporting the end of the trunk 28, rather than relying upon the base member 12 and/or simple wedging of the trunk within the tapered side wall as shown. It is also contemplated that a liner may be placed within the receptacle 18 to reduce its cross sectional dimensions to accommodate trees having trunks of small diameters. Further, the dimensions and materials employed in practicing the invention may vary, while remaining within the confines of the scope of the invention. The assembly 10 may be fabricated of metal construction, or may be molded from plastic or similar materials. The base plate 12 will typically have a diameter on the order of 20–30 inches, with the stand having a height from the base 12 to the aperture 16 on the order of 8–15 inches. The opening of the aperture 16 will typically be on the order of 4–8 inches. It will be appreciated that the base 12 provides a stable support for the stand 10, with the mass thereof being greatly increased by the introduction of water into the cavity 26 and receptacle 18. Accordingly, the center of gravity of the unit comprising the stand 10 and associated tree becomes significantly low, close to the broad base 12, making the entire assembly quite stable and safe.

It will also be appreciated by those skilled in the art that various types of structural foams can be used for forming the frustro conical ring 32 within the cavity 18 about the tree trunk 28. A closed cell foam having a cell density greater than 85 percent is preferred. Suitable foams can be of polyurethane or polystyrene. Of course, such structural foams are well known and employed in industry.

It will also be apparent to those skilled in the art that material other than foam might be used to provide the securing function. For example, quickly setting concretes or the like might also be employed.

Thus it can be seen that the objects of the invention have been satisfied by the structure presented above. While in accordance with the patent statutes only the best mode and preferred embodiment of the invention has been presented and described in detail, it is to be understood that the invention is not limited thereto or thereby. Accordingly, for an appreciation of the true scope and breadth of the invention reference should be made to the following claims.

What is claimed is:

1. A stand for receiving and securing a cut tree comprising:

a base plate;

a first side wall extending upwardly from said base plate to an aperture at a top end thereof;

a receptacle formed by a second side wall depending from said aperture for receiving a trunk of a cut tree;

securing means interposed between said trunk and second side wall for holding said trunk in a fixed position within said receptacle; and wherein said first side wall defines a cavity, said first side wall having an opening therein for receiving water into said cavity.

2. The stand for a cut tree according to claim 1, wherein said securing means comprises a solidified foam.

3. The stand for a cut tree according to claim 2, wherein said second side wall is frustro conical, having a maximum diameter at said aperture.

4. The stand for a cut tree according to claim 3, wherein said solidified foam forms a frustro conical ring about said trunk.

5. The stand for a cut tree according to claim 4, wherein said side wall is frustro conical, extending from said base plate to said aperture.

6. The stand for a cut tree according to claim 1, wherein said cavity communicates with said receptacle.

7. The stand for a cut tree according to claim 2, wherein said solidified foam is a closed cell foam.

8. A method for setting a tree in a stand, comprising:

(a) providing a receptacle having a first sidewall having an opening therein and extending upwardly from a base to an aperture;

(b) inserting the trunk of a tree through said aperture;

(c) providing a layer of water in said receptacle;

(d) providing a layer of hardenable material on said layer of water;

(e) allowing said material to harden; and (f) replenishing said layer of water when needed through said opening.

* * * * *